US007922596B2

(12) United States Patent
Vanderbilt et al.

(10) Patent No.: US 7,922,596 B2
(45) Date of Patent: Apr. 12, 2011

(54) PUTTER AND GOLF BALL DEFORMITY MEASURING APPARATUS

(75) Inventors: Essay Anne Vanderbilt, Gilbert, AZ (US); Gerolin Jordan, Gilbert, AZ (US)

(73) Assignee: Stanley Andrew Brothers LLC, Seattle, WA (US)

( * ) Notice: Subject to any disclaimer, the term of this patent is extended or adjusted under 35 U.S.C. 154(b) by 0 days.

(21) Appl. No.: 12/171,562

(22) Filed: Jul. 11, 2008

(65) Prior Publication Data

US 2010/0009781 A1 Jan. 14, 2010

(51) Int. Cl.
*A63B 69/36* (2006.01)
*A63B 53/04* (2006.01)
*A63B 47/02* (2006.01)

(52) U.S. Cl. ..... 473/251; 473/286; 473/340; 473/408; 294/19.2

(58) Field of Classification Search ..... 473/241, 473/249, 286, 251–255, 408, 324–350, 313–314, 473/287–292; D21/736–746; 294/19.2; 33/501, 555.2; 73/12.02
See application file for complete search history.

(56) References Cited

U.S. PATENT DOCUMENTS

| | | | | | |
|---|---|---|---|---|---|
| 777,400 | A | * | 12/1904 | Clark | 473/329 |
| 1,569,295 | A | * | 1/1926 | Munson | 473/350 |
| 1,960,110 | A | | 5/1934 | Iles | |
| 2,056,335 | A | * | 10/1936 | Wettlaufer | 473/245 |
| 2,530,446 | A | | 11/1950 | Beardsley | |
| 3,042,405 | A | | 7/1962 | Solheim | |
| 3,185,483 | A | * | 5/1965 | Klynman | 473/286 |
| 3,310,309 | A | | 3/1967 | Moss | |
| D216,138 | S | * | 11/1969 | Carignan | D21/721 |
| 3,632,112 | A | | 1/1972 | Jacobs | |
| 3,708,172 | A | * | 1/1973 | Rango | 473/249 |
| 3,841,639 | A | | 10/1974 | Werner | |
| 4,248,430 | A | | 2/1981 | Kepler | |
| 4,795,158 | A | * | 1/1989 | Kuykendall | 473/201 |
| D349,319 | S | | 8/1994 | Bayer | |
| 5,407,194 | A | * | 4/1995 | Snow | 473/131 |
| 5,417,426 | A | | 5/1995 | Bayer | |
| 5,524,889 | A | * | 6/1996 | Rush | 473/286 |
| 5,692,968 | A | * | 12/1997 | Shine | 473/286 |
| 5,830,075 | A | * | 11/1998 | Hirose | 473/313 |
| 5,857,922 | A | * | 1/1999 | Delio | 473/313 |
| 6,001,031 | A | * | 12/1999 | San Juan | 473/340 |
| 6,176,792 | B1 | | 1/2001 | Tate | |
| 6,435,975 | B2 | | 8/2002 | Middleton | |
| 6,878,071 | B1 | * | 4/2005 | Schwieger et al. | 473/284 |
| 6,964,619 | B1 | * | 11/2005 | Mejia | 473/286 |
| 6,986,716 | B2 | * | 1/2006 | Lukasiewicz et al. | 473/340 |
| 7,037,211 | B1 | | 5/2006 | Kosovac | |
| 7,048,648 | B2 | | 5/2006 | Breier et al. | |
| 7,059,971 | B1 | * | 6/2006 | Schmitt | 473/285 |
| 7,086,959 | B2 | * | 8/2006 | D'Agguano | 473/282 |
| 7,223,178 | B2 | | 5/2007 | Henry | |
| 7,335,112 | B1 | | 2/2008 | Bitondo et al. | |
| 7,559,848 | B2 | * | 7/2009 | Nickel | 473/286 |
| 2002/0147055 | A1 | | 10/2002 | French | |
| 2005/0221908 | A1 | | 10/2005 | Gornall | |
| 2007/0191131 | A1 | | 8/2007 | Nickel | |
| 2007/0238550 | A1 | * | 10/2007 | Tateno | 473/340 |
| 2007/0254748 | A1 | * | 11/2007 | Stellander | 473/340 |
| 2009/0275420 | A1 | * | 11/2009 | Tanaka | 473/286 |

* cited by examiner

*Primary Examiner* — Sebastiano Passaniti
(74) *Attorney, Agent, or Firm* — Booth Udall, PLC

(57) ABSTRACT

A putter and golf ball deformity measuring apparatus is described. A putter head comprises a front portion, a rear portion, a bottom portion defining an oblong through hole, and a containment area above the oblong through hole sized and shaped to surround at least a portion of a golf ball without gripping the golf ball, the containment area defined between the front portion and the rear portion.

22 Claims, 16 Drawing Sheets

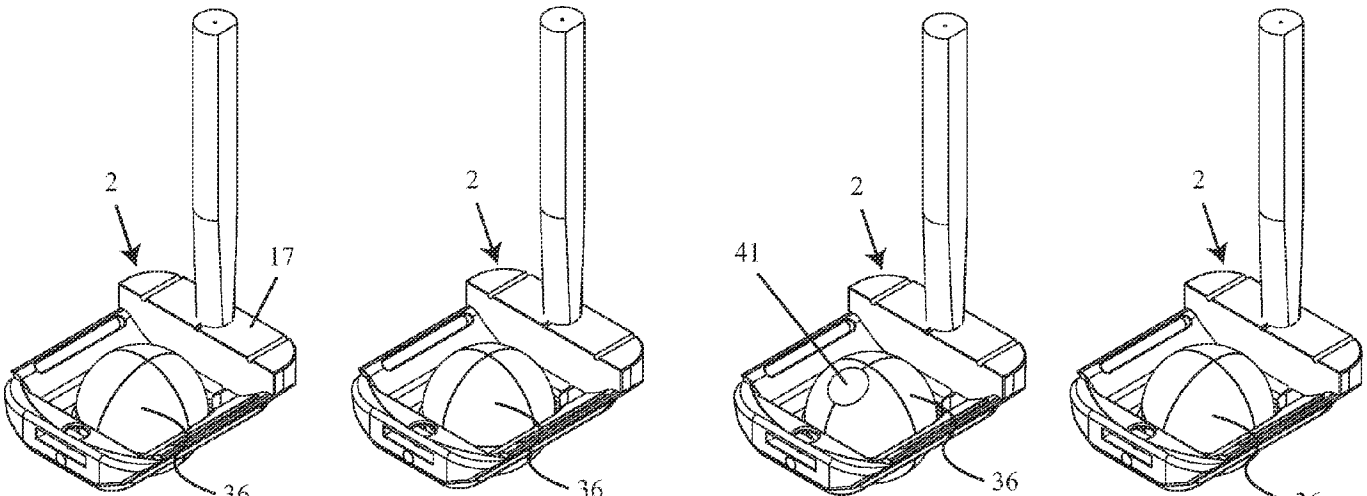
FIG. 12A
FIG. 12B
FIG. 12C
FIG. 12D
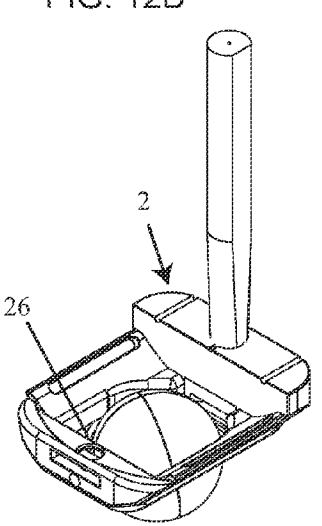
FIG. 12F
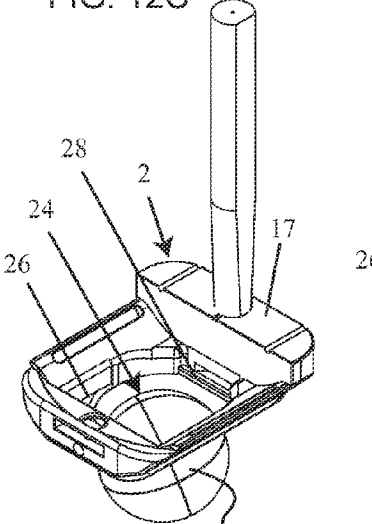
FIG. 12G
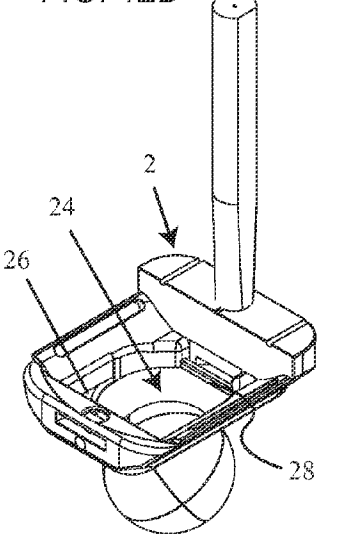
FIG. 12H
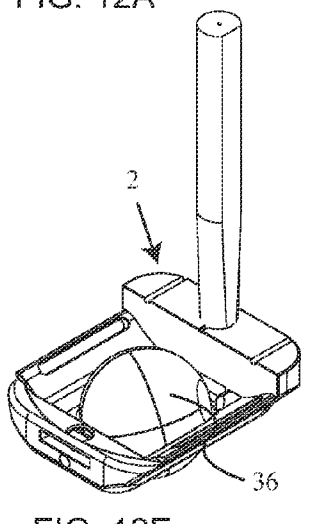
FIG. 12E

PUTTER AND GOLF BALL DEFORMITY MEASURING APPARATUS

BACKGROUND

1. Technical Field

Aspects of this document relate generally to putters and golf ball deformity measuring apparatuses.

2. Background Art

Monitoring, identifying and removing deformed gall balls from play serves an important role in maintaining the reliable and efficient operation of golf balls during the course of golf play. Significantly, except in limited circumstances (such as a player inspecting their golf ball for damage after announcing their intention to do so, identifying their golf ball in a hazard, and/or lifting and cleaning their golf ball in the fairway when so allowed by local rules and under certain conditions, and/or as allowed by other rules propounded by the United States Golf Association "U.S.G.A." and/or the Royal and Ancient Golf Club of St. Andrews, Scotland), a golf player is prohibited from touching their golf ball with their hand until the ball has been played onto a designated "green," or putting surface. In particular, once a player tees-off their golf ball (hits their first shot on a particular golf hole), the player may not ordinarily touch the ball with their hand without penalty until the ball successfully comes to rest on the green.

Once a player has successfully played their ball onto the putting green, the player is allowed under U.S.G.A. rules to mark their ball and then lift the ball. Of course, once a player lifts their ball, they may visually inspect it for adhered dirt, cuts, cracks, or other deformities that might cause the ball roll off-line. In the case of a golf ball that is merely dirty, the player may clean the ball before replacing the ball on the player's mark and resuming play. In the case of a golf ball that is visibly cut, cracked, or out of shape, the ball may be declared "unfit for play" under U.S.G.A. rules, and a player is entitled to substitute another ball for the unfit one, by placing the substitute ball on the player's mark. Nevertheless, if, upon inspection, a player determines that a ball is not "unfit for play," the original ball must be replaced.

It will be understood that a cut, cracked, or out-of-shape golf ball that remains undetected by a player may cause undesirable effects during the course of play. In some cases, the undesirable effects of a golf play that is unfit for play may not be easily discernible to a player and may not occasion any noticeable consequences to the player. In other instances, a cut, cracked or out-of-shape golf ball may cause the ball to undesirably deviate from the trajectory on which the ball was put by a player. In particular, a golf ball that is unfit for play may deviate not only from its trajectory on full and partial shots played from the tee, the fairway, the rough and from around the green but, significantly, may also stray from its line when putted on the putting surface.

Accordingly, in those cases where a player is unaware that their ball is unfit for play (especially where the ball is only mildly out-of-shape), the player may be unaware that they should take their ball out of play and therefore may continue to suffer the consequences of playing a ball that is unfit for play, not only on the current hole being played by the player, but on subsequent golf holes, as well. Conventional golf-ball conformity testing devices exist. Nevertheless, such prior art devices may not allow a golfer to, without bending down, simultaneously check their golf ball for conformity while picking up their ball from the putting surface (or from within the golf hole) with their putter, and may lack other advantages as well.

For many golfers, particularly the aged and infirm, physically bending down to pick up a golf ball from off of the ground or out of a golf hole (or performing other tasks typically required of a golfer during the course of play that may require a golfer to bend over, such as, among other examples, repairing ball marks left by a player's ball) may be difficult or uncomfortable, or even impossible. Conventional devices exist for allowing a golfer to pick up a golf ball without the requirement of bending down. Nevertheless, such conventional devices may either compress a golf ball by impingement in an opening having a diameter slightly smaller than the diameter of a regulation golf ball or, otherwise, the devices themselves may comprise an element that is designed to deform in order to allow a regulation golf ball to pass therethrough. Other conventional devices for assisting individuals in picking up their golf balls without bending over also exist and may comprise suction-cup type or other elements.

Accordingly, improved devices, methods, and systems for efficiently monitoring, identifying and removing from play golf balls that are "unfit for play," as well as performing other functions typically required during the course of golf play, without bending over, are needed.

SUMMARY

In one aspect, a putter and golf ball deformity measuring apparatus comprises a putter head having a front portion, a rear portion, a bottom portion defining an oblong through hole, and a containment area above the oblong through hole sized and shaped to surround at least a portion of a golf ball without gripping the golf ball, the containment area defined between the front portion and the rear portion.

Particular implementations of putter and golf ball deformity measuring apparatuses may include one or more of the following. The containment area may be crescent shaped in cross section. The containment area may comprise one or more opposing visual alignment slots. The oblong through hole may comprise a spanning truss bar and an opposing beveled contact area. The spanning truss bar may comprise an indentation facing the beveled contact area. A marker seat defined in an edge of the oblong through hole, and a marker through slot defined between the truss bar and the marker seat may be provided. The front portion may comprise a putter face. The putter face may comprise a thermoplastic insert. The putter face may comprise a tactile orifice behind the thermoplastic insert. A shaft extending from the front portion of the putter head, wherein the putter face comprises a negative loft angle and at least a portion of the shaft is ahead of at least a portion of the putter face when the putter head is horizontal may be provided. The rear portion may comprise a leveling aid. The putter head may comprise a rear section, and the rear section may comprise a magnet. The putter head may comprise a rear section, and the rear section may comprise a divot tool docking port.

In another aspect, a putter and golf ball deformity measuring apparatus comprises a putter head having a front portion, the front portion comprising a putter face, the putter face comprising a negative loft angle, and a shaft extending from the front portion of the putter head, wherein at least a portion of the shaft is ahead of at least a portion of the putter face when the putter head is horizontal.

Particular implementations of putter and golf ball deformity measuring apparatuses may include one or more of the following. The putter head may further comprise a rear portion, a bottom portion defining an oblong through hole, and a containment area above the oblong through hole sized and shaped to surround at least a portion of a golf ball without gripping the ball, the containment area defined between the front portion and the rear portion. The containment area may be crescent shaped in cross section. The containment area may comprise one or more opposing visual alignment slots. The oblong through hole may comprise a spanning truss bar and an opposing beveled contact area. The spanning truss bar may comprise an indentation facing the beveled contact area. A marker seat defined in an edge of the oblong through hole and a marker through slot defined between the truss bar and the marker seat may be provided. The putter face may comprise a thermoplastic insert. The putter face may comprise a tactile orifice behind the thermoplastic insert. The rear portion may comprise a leveling aid. The rear portion comprises a magnet. The rear portion may comprise a divot tool docking port.

In still another aspect, a method of measuring golf ball diameter and deformity comprises aligning over a golf ball an oblong through hole defined in a bottom portion of a putter head, pushing the putter head downward so that the golf ball walks upward between a spanning truss bar and an opposing beveled contact area of the oblong through hole, and passing the golf ball through the oblong through hole into a containment area above the oblong through hole and defined between a front portion and a rear portion of the putter head so that at least a portion of the golf ball is surrounded in a containment area without gripping the golf ball.

Particular implementations of a method of measuring golf ball diameter and deformity may include one or more of the following. The method may comprise lifting the putter head upward so that the golf ball rests freely against the spanning truss bar and the opposing beveled contact area, and rotating the golf ball on one or more axes. The method may comprise inserting a putter head into a golf hole containing a golf ball, aligning a rear portion of the putter head behind the golf ball so that at least a portion of the rear portion is below at least a portion of a front portion of the putter head, and wherein the step of pushing the putter head downward may comprise pushing the putter head downward by slideably rocking the putter head against the golf hole so that the golf ball walks upward between a spanning truss bar and an opposing beveled contact area of the oblong through hole and so that at least a portion of the rear portion of the putter head is above at least a portion of the front portion of the putter head. The method may comprise lifting the putter head upward so that the golf ball rests freely against the spanning truss bar and the opposing beveled contact area, and rotating the golf ball on one or more axes.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and:

FIGS. 12*a*-12*h* illustrate perspective view of an exemplary method of picking up and simultaneously checking a golf ball for deformity;

DESCRIPTION

Figure 1:
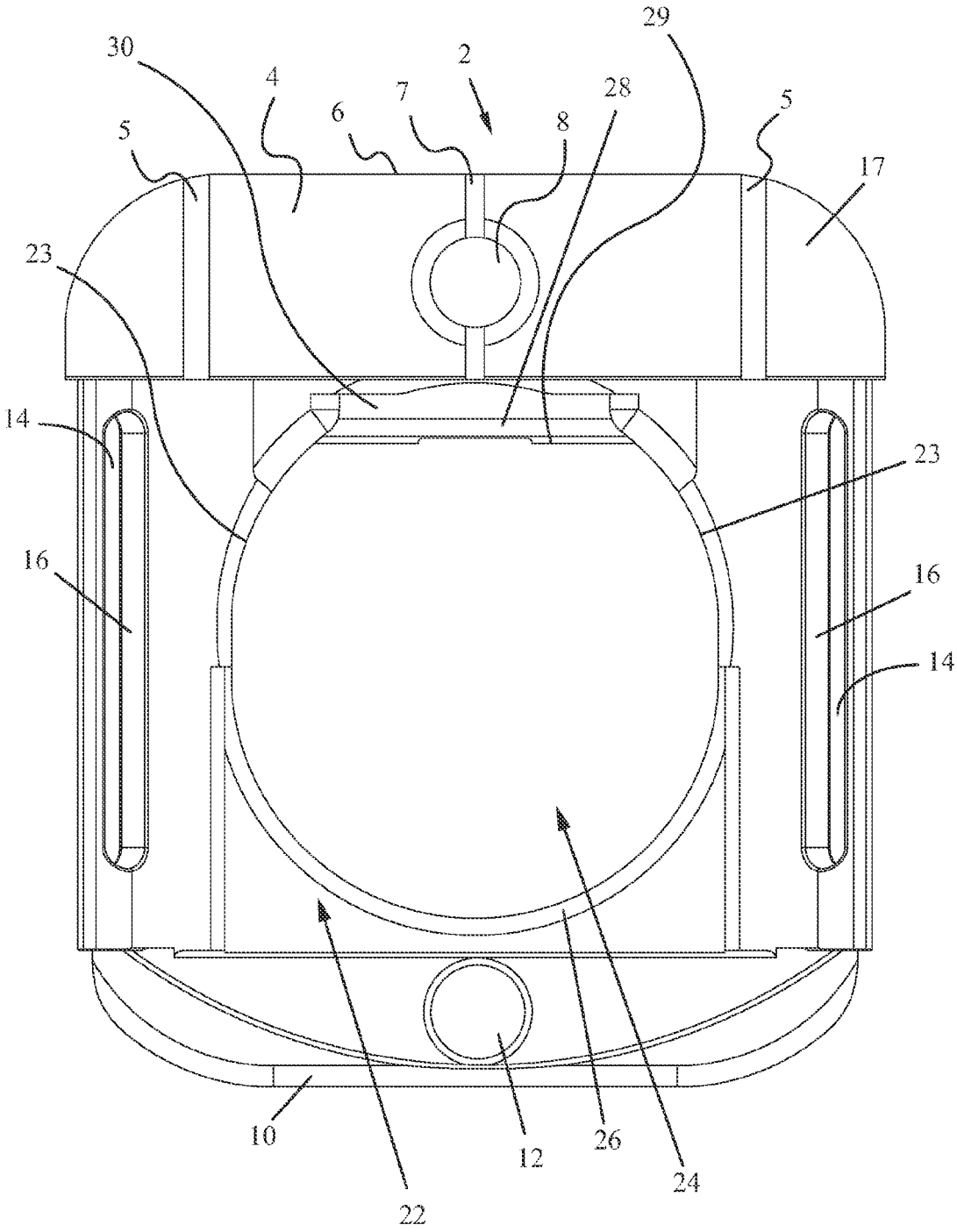
FIG. 1 is a top view of a putter and golf ball deformity measuring apparatus.
Figure 2:
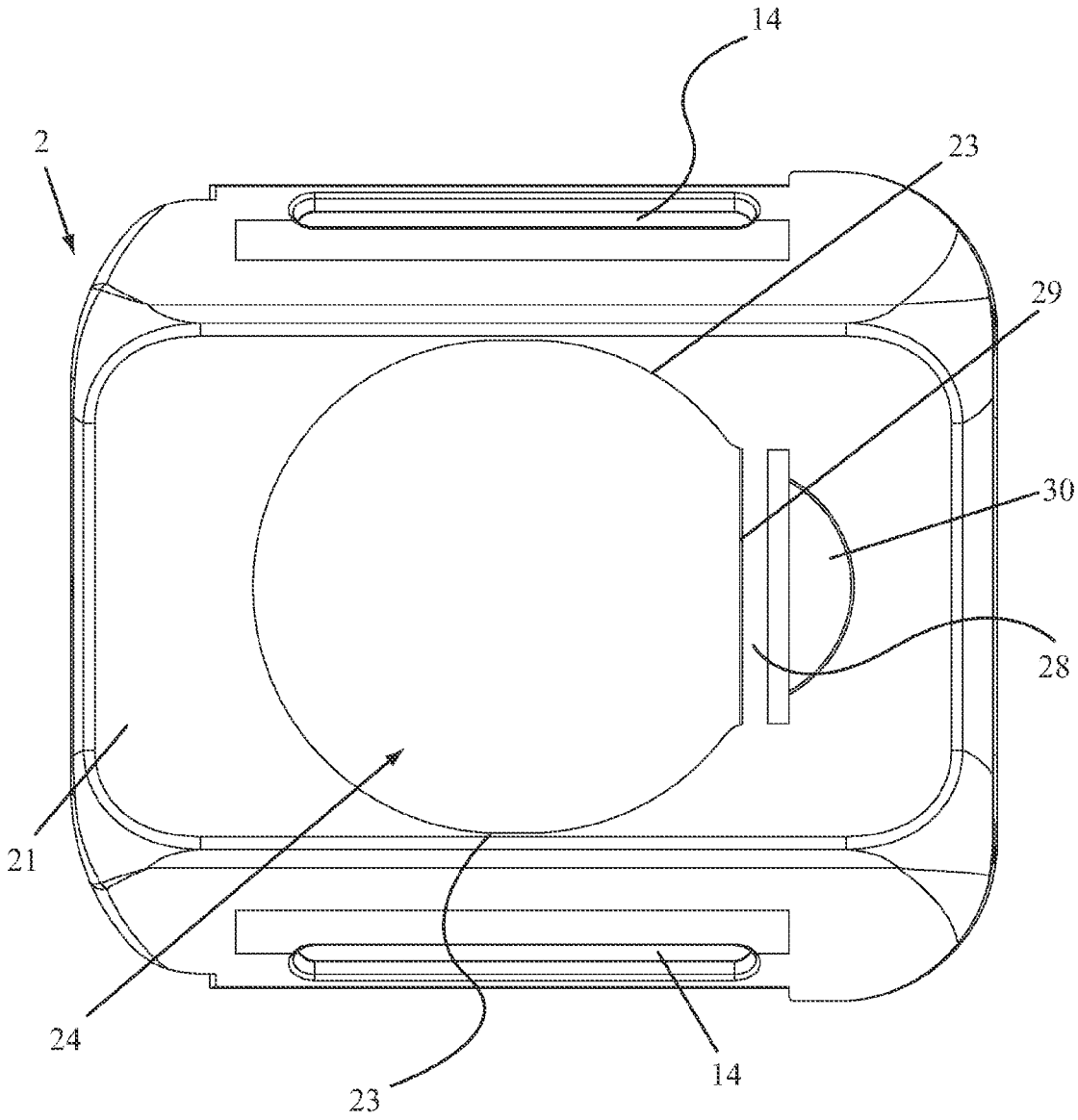
FIG. 2 is a bottom view of a putter and golf ball deformity measuring apparatus.

This document features a putter and golf ball deformity measuring apparatus. There are many features of a golf putter disclosed herein, of which one, a plurality, or all features may be used in any particular implementation.

There are a variety of golf putter implementations. Notwithstanding, with reference to FIGS. 1-6, various views of a putter and golf ball deformity measuring apparatus are illustrated. Many advantages are made possible, either in combination or separately, from particular implementations of a putter and golf ball deformity measuring apparatus disclosed in the present application. Those advantages relate, among other things, to monitoring, diagnosing and removing damaged golf balls from play. Golf balls are often subjected to great forces during use, whether from a golf club striking the golf ball, or from a moving golf ball impacting another object. As a result of the forces they are subjected to, golf balls may frequently become cut, cracked, or become out of shape, which may result in various operational problems. As such, the ability to conveniently monitor a golf ball's integrity, to diagnose a golf ball's fitness for play and, in some cases, remove from play a golf ball that is "unfit for play" is extremely beneficial.

Structure/Components

FIGS. 1-6 illustrate various views of a putter and golf ball deformity measuring apparatus. Putter head 2 comprises front portion 4, rear portion 10, opposing visual alignment slots 14, upper surface 17 and bottom surface 21. In particular implementations, opposing visual alignment slots 14 may comprise one or more colored portions 16, which may further assist in providing a visual indication when the putter head is properly aligned with respect to a golf ball and/or a golf hole. In particular, when putter head 2 is aligned properly, a user may only see one or more colored portions 16 through the opposing visual alignment slots 14, thereby receiving a visual indication that putter head 2 is aligned properly. When putter head 2 is not aligned properly, a user may see the ground through the opposing visual alignment slots 14, thereby receiving an indication that putter head 2 is not aligned properly.

Referring still to FIGS. 1-6, it will be understood that bottom surface 21 comprises a lower surface (which faces the ground during a golf stroke) and an upper surface (which faces skyward). Bottom surface 21 further comprises oblong through hole 24, which comprises perimeter edge 23. Perimeter edge 23 defines the perimeter of oblong through hole 24 and is disposed between the upper and lower surfaces of bottom surface 21. Oblong through hole 24 further comprises spanning truss bar 28 and opposing beveled contact area 26 (also known as a golf ball lifting bevel). In particular implementations, spanning truss bar 28 comprises flat surface 29. In other particular implementations, flat surface 29 may be disposed within a notch or indentation comprising spanning truss bar 28. In still other particular implementations, truss bar 28 may be adjustable such as, by way of non-limiting example, by bending. In any event, it will be understood that flat surface 29 comprising spanning truss bar 28 faces, or opposes, beveled contact area 26. In particular implementations, beveled contact area 26 may be tapered so that the portion of beveled contact area 26 facing spanning truss bar 28 comprises less of an angle than the portion of perimeter edge 23 immediately adjacent to the opposing visual alignment slots 14. In other particular implementations, the angle of the portion of beveled contact area 26 directly facing or spanning truss bar 28 comprises a bevel of about 32 arc degrees. In addition, putter head 2 comprises containment area 22, which is configured to surround at least a portion of a golf ball without gripping the golf ball after the golf ball has passed upwards through oblong through hole 24. Containment area 22 is defined at least by: the upper surface of bottom surface 21; front portion 4; rear portion 10; and opposing visual alignment slots 14.

Still referring to FIGS. 1-6, front portion 4 comprises putter face 6. It will be understood that putter face 6 comprises the striking surface of putter head 2, that is, the portion of putter head 2 with which a user strikes a golf ball. In particular implementations, putter face 6 may comprise a thermoplastic insert such as, by way of non-limiting example, a Lexan® insert. In other particular implementations, putter face 6 may comprise tactile orifice 3 which may comprise a hole through putter face 6 and may provide an auditory indication in the event of a well-struck putt. In other particular implementations, putter face 6 may comprise a negative loft. Loft refers to the amount of angle a golf club face has in relation to an imaginary vertical line, which represents 0 degrees of loft. A golf club face loft above 0 degrees (positive loft), generally translates into a lofted ball flight when a golf ball is struck. Since it is desirable to have a golf ball immediately roll on-line when the golf ball is putted, and to avoid the ball from lofting, golf putter faces typically comprise very little loft, usually less than 10 degrees. The more loft that a club face has the more "lofted" the club face is said to be. Conversely, the lower the loft of a club is, the less lofted he club face is said to be. Therefore, negative loft refers to a putter face loft that has less loft than an imaginary vertical line representing 0 degrees of loft.

In particular implementations, a removable wedge attachment (not shown) may be coupled with front portion 4 (or with putter face 6 in particular implementations) in order to provide a positively lofted face with which to cause a higher launch angle when a golf ball is struck. It will be understood that a variety of removable wedge attachments comprising a variety of positive lofts may be provided. In other particular implementations, front portion 4 may comprise one or more alignment channels 5, one or more center alignment channels 7, and a hosel 8 (also known as a shaft boss). It will be understood that a golf putter shaft may be coupled with hosel 8. A golf putter shaft comprises a proximal end (which is coupled with the hosel 8) and a free distal end (which may comprise a grip). In particular implementations, the shaft may be forward leaning, that is, a portion of the free distal end comprising the shaft may be ahead of at least a portion of putter face 6 when bottom surface 21 is resting substantially coextensively with a flat, level, horizontal surface.

Figure 3:
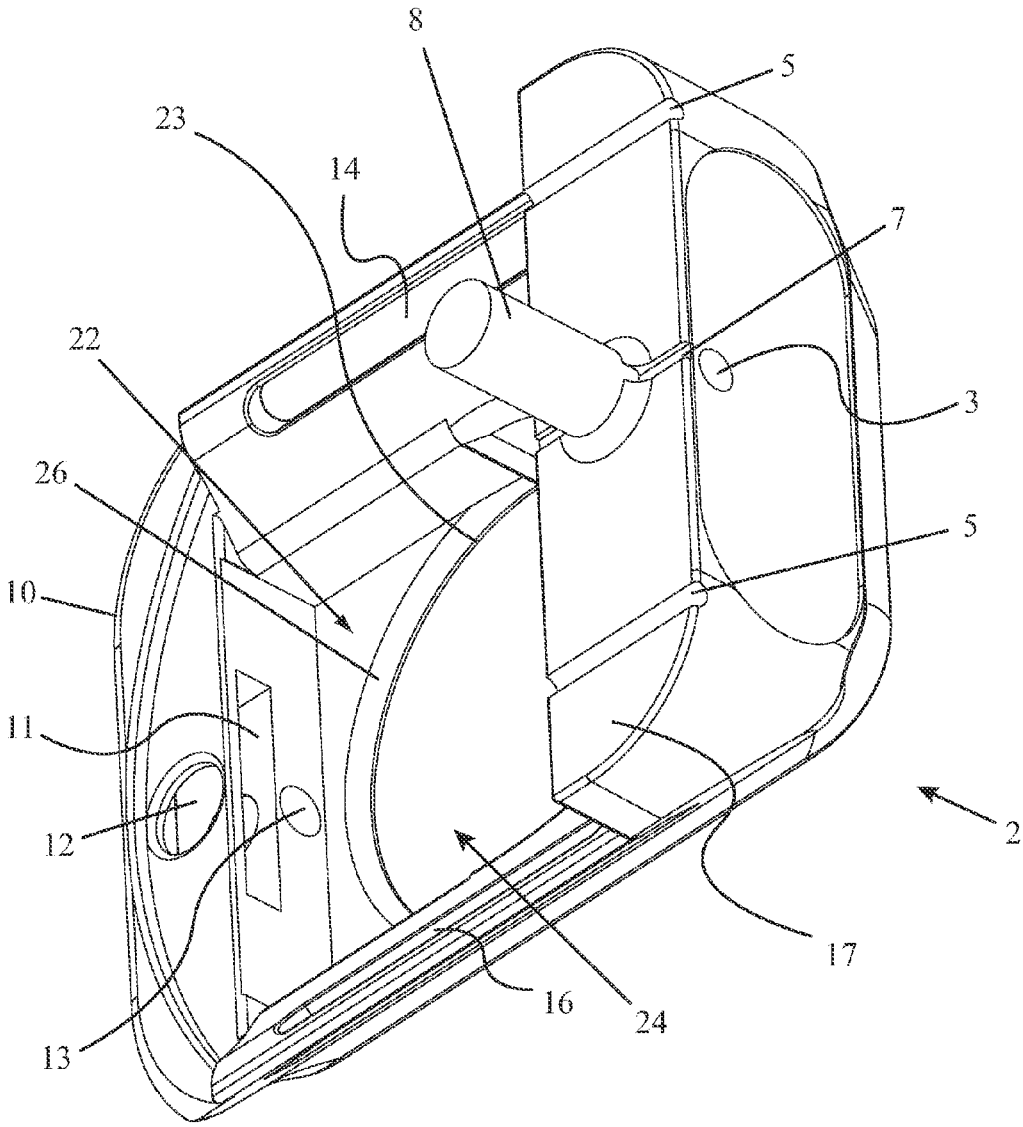
FIG. 3 is a front perspective view of a putter and golf ball deformity measuring apparatus.
Figure 4:
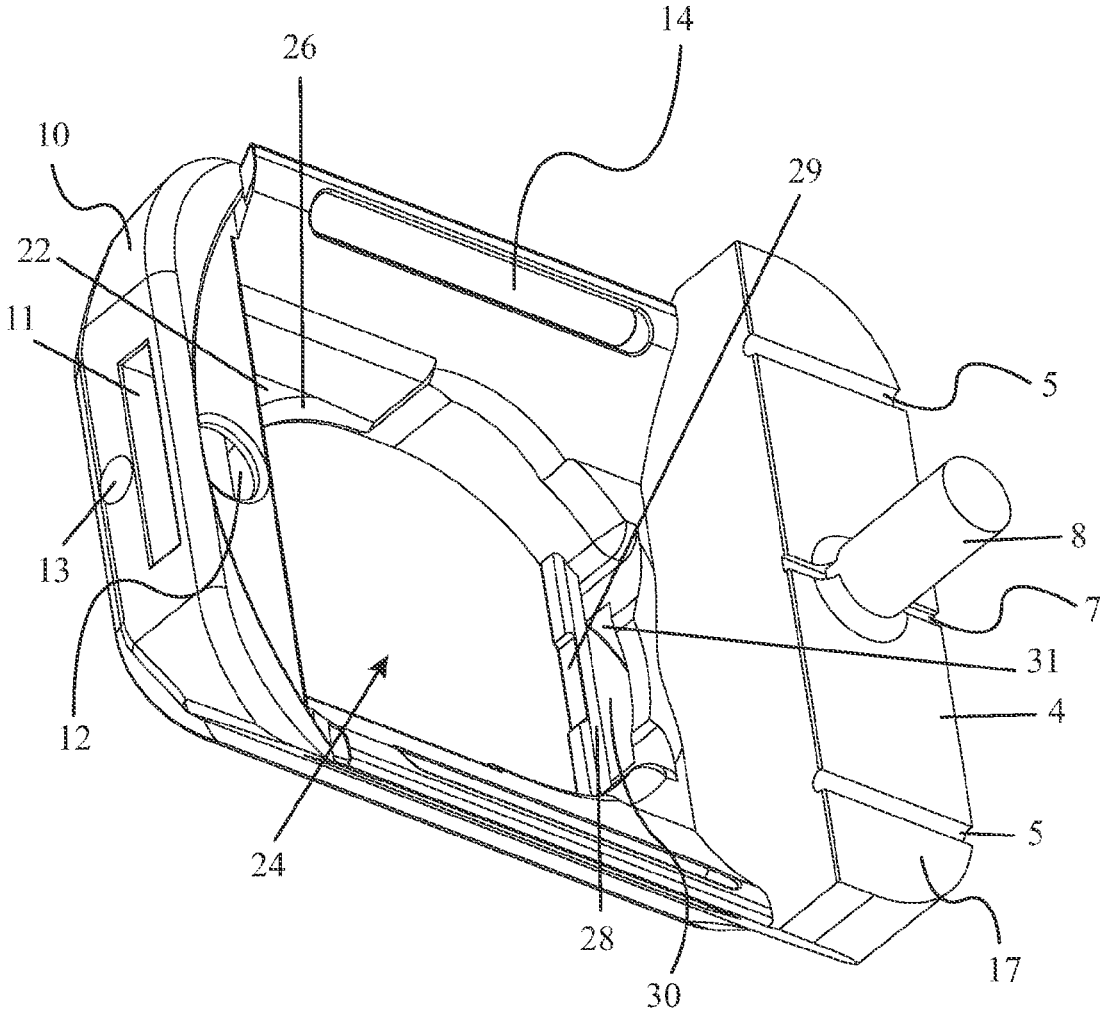
FIG. 4 is a rear perspective view of a putter and golf ball deformity measuring apparatus.
Figure 5:
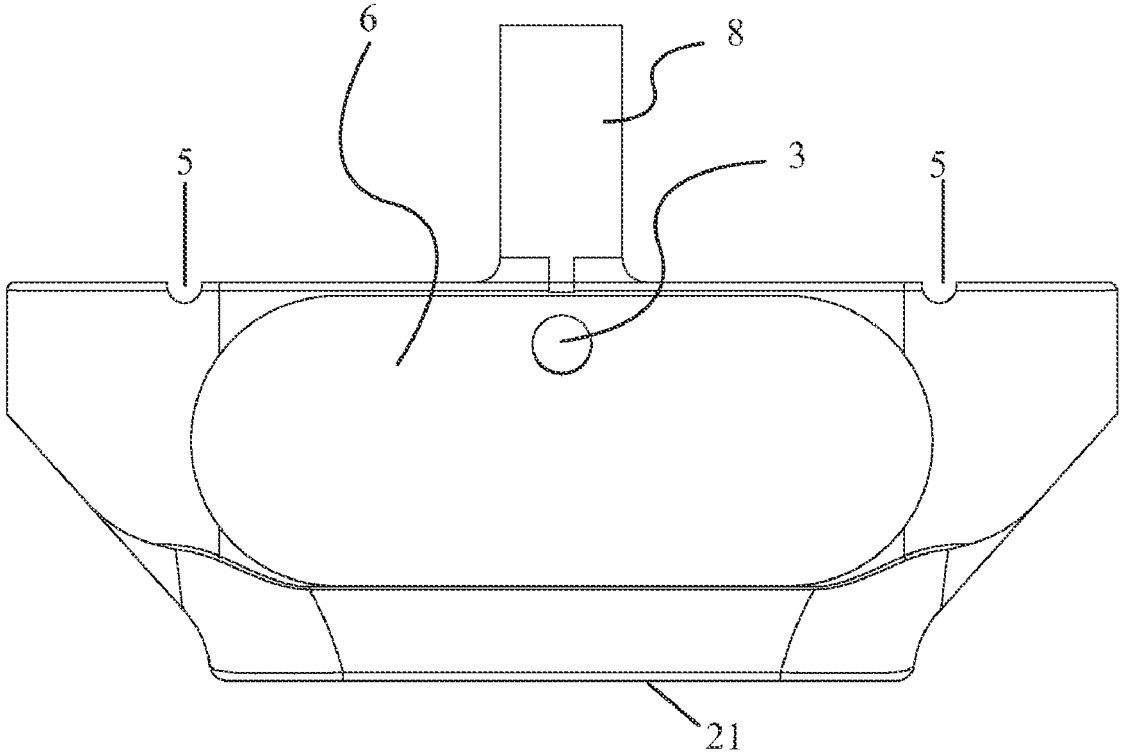
FIG. 5 is a front view of a putter and golf ball deformity measuring apparatus.
Figure 6:
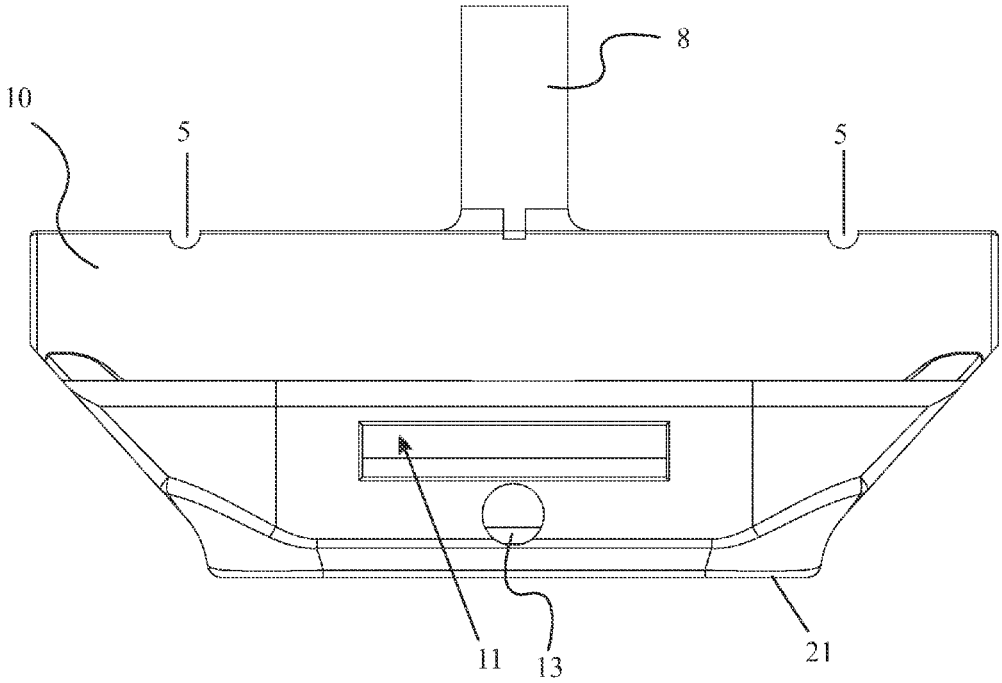
FIG. 6 is a rear view of a putter and golf ball deformity measuring apparatus.
Figure 7A:
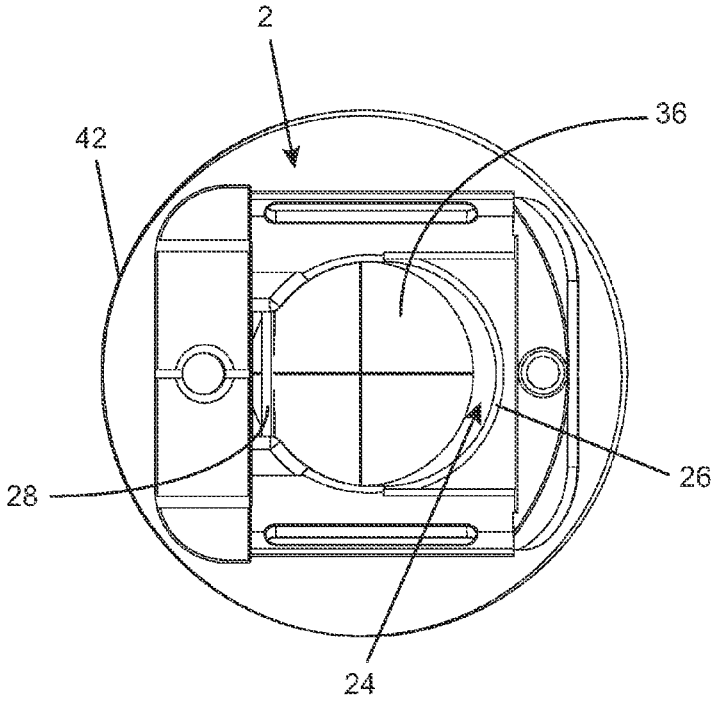
FIGS. 7*a*-7*h* are side views of a method of picking up a golf ball from within a golf hole.
Figure 7B:
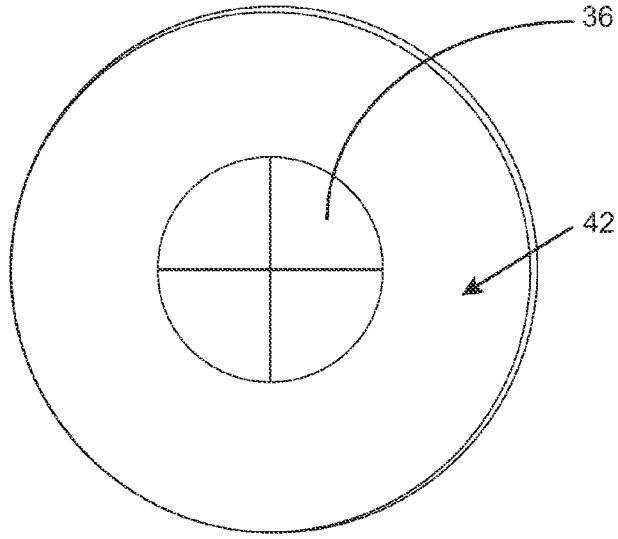
Figure 7C:
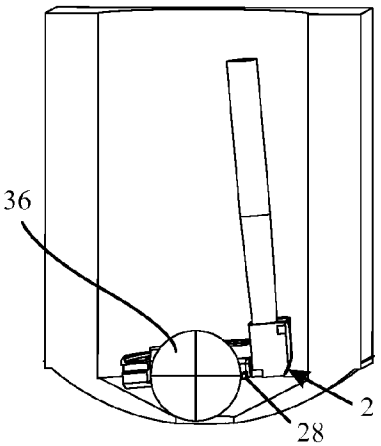
Figure 7D:
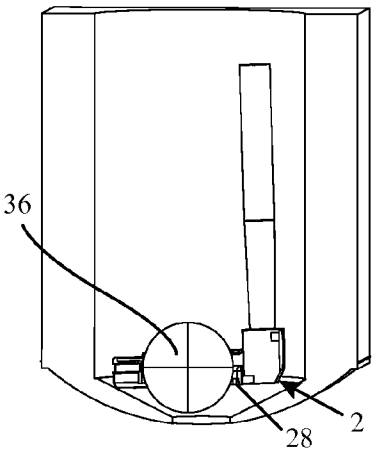
Figure 7E:
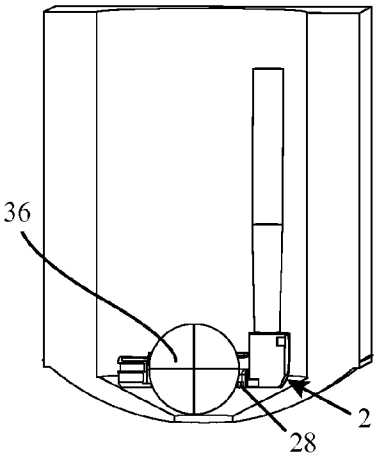
Figure 7F:
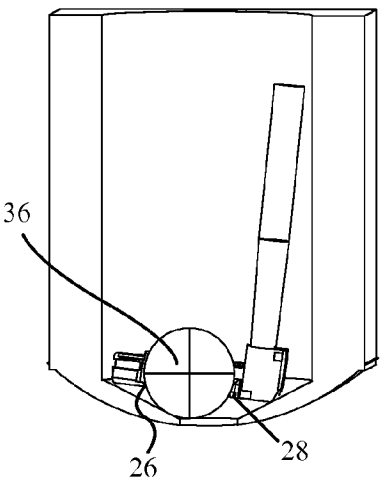
Figure 7G:
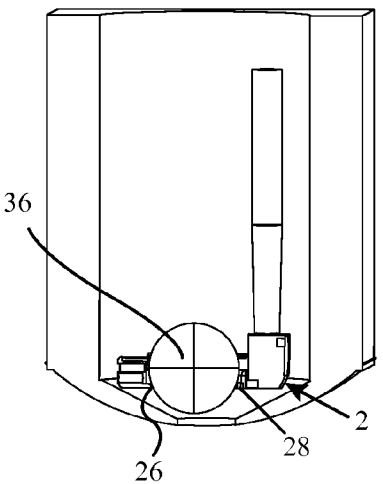
Figure 7H:
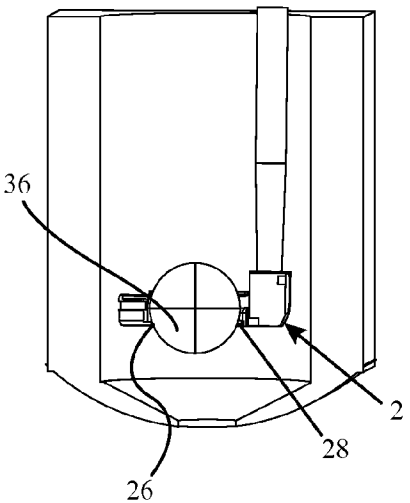

In addition to the foregoing, putter head 2 may comprise marker through slot 30 and ball marker seat 31, which are configured to accept ball marker 34 for placement behind a golf ball (described further with respect to the "Operation/Use" section below). Referring specifically to FIGS. 3 and 4, in particular implementations, rear portion 10 may comprise divot tool docking port 11, which is configured to hold in-place divot tool 32 (FIGS. 7*a* and 7*b*). Also, in particular implementations, rear portion 10 may further comprise leveling aid 12. In particular implementations, leveling aid 12 comprises a hole in upper surface 17 and a painted portion within divot tool docking port 11. In particular implementations, when putter head 2 is aligned properly, a user may see a complete white (or other color) circle through the hole in upper surface 17. Nevertheless, when putter head 2 is misaligned, a user may see an incomplete colored circle through the hole through upper surface 17 comprising leveling aid 12, or may see the appearance of dark-colored crescents. Therefore, it will be understood that leveling aid 12 provides a visual indication of a properly aligned putter head 2. In addition, in other particular implementations, rear portion 10 may comprise magnet 13 (which may be used to pick up a ball marker without bending down as described more fully below).

Figure 8B:
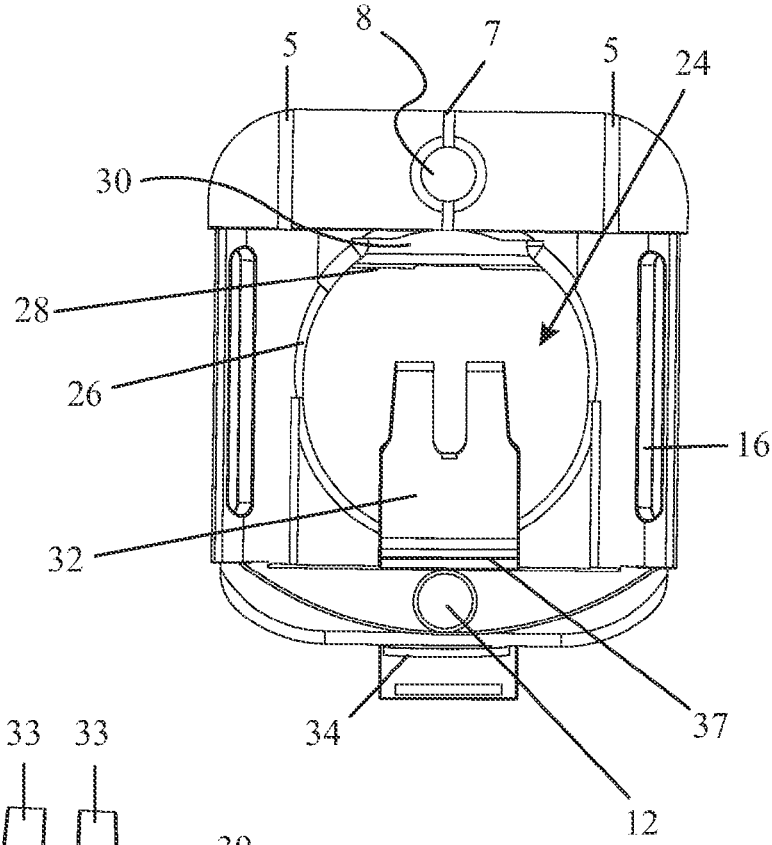
FIGS. 8*a* and 8*b* are top views of a putter and golf ball deformity measuring apparatus with divot repair tool.
Figure 8A:
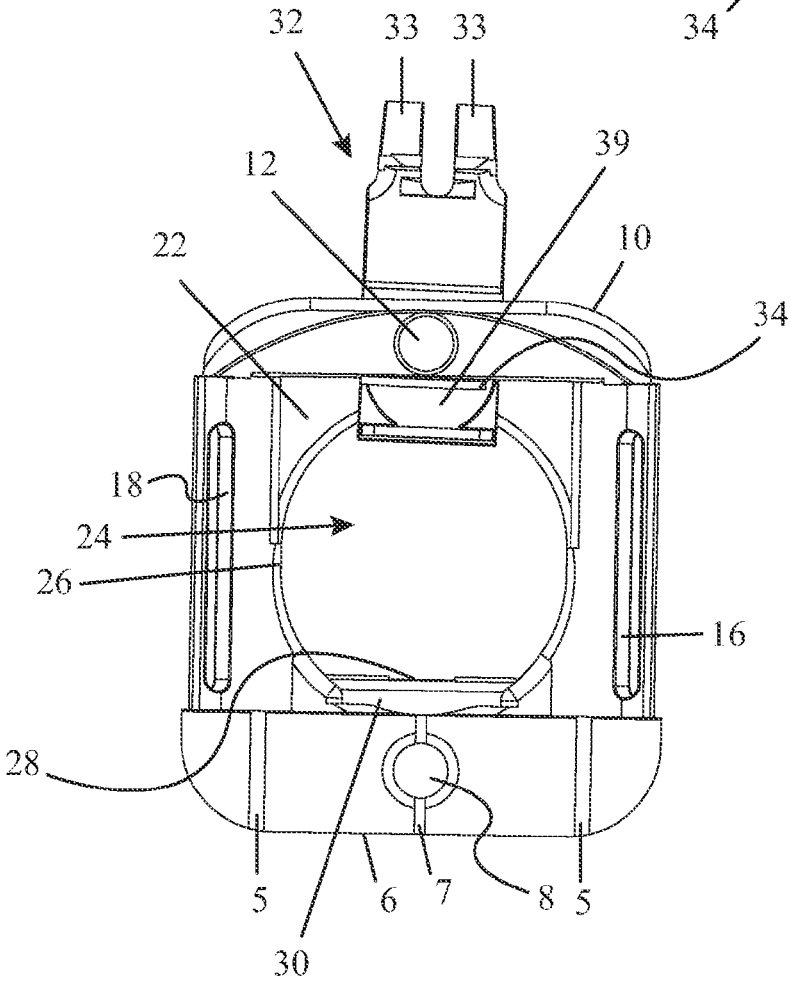

FIGS. 8*a* and 8*b* illustrate non-limiting examples of a putter and golf ball deformity measuring apparatus in conjunction with divot repair tool 32. Divot repair tool 32 comprises divot repair tool body 39, one or more tines 33, ball marker 34, and slot 35 (obscured by ball marker 34). Divot repair tool body may be passed through divot tool docking port 11 (FIGS. 3 and 4) so that slot 35 is located within containment area 22. A user may insert ball marker 34 into slot 35 such that ball marker 34 is perpendicularly removably coupled with divot repair tool body 39. In addition, in particular implementations, divot repair tool 32 may comprise a step 37 (FIG. 8*b*) or other detenting feature which may prevent divot repair tool 32 from passing all the way into containment area 22 when ball marker 34 is inserted in slot 35 as shown.

FIGS. 9*a*-9*k* illustrate a non-limiting example of a putter head comprising a ball marker 34, marker seat 31, marker through slot 30, oblong through hole 24, and spanning truss bar 28, the operation of which are described below.

Other Implementations

Many additional putter and golf ball deformity measuring apparatus implementations are possible.

For the exemplary purposes of this disclosure, in some implementations, the alignment channels, one or more opposing visual alignment slots and/or the leveling aid may not be included.

For the exemplary purposes of this disclosure, in some implementations, the divot tool and/or divot tool docking port may not be included.

For the exemplary purposes of this disclosure, in some implementations, a marker through slot, marker seat, and/or a magnet may not be provided.

For the exemplary purposes of this disclosure, in some implementations, the putter face may also include a removable wedge attachment, a thermoplastic insert and/or a tactile orifice.

All of the foregoing and other implementations may comprise or exhibit one or more of the following advantages, among others: putter and golf ball deformity measuring apparatus implementations may assist in picking up golf balls from a surface or from within a golf hole without bending over; in monitoring, identifying and removing deformed gall balls from play without bending over; marking the position of a golf ball with a ball marker (and picking up the marker) without bending over; repairing a ball mark or divot without bending over; storing a divot tool without bending over; and picking up a golf flag stick or golf club handle without bending over.

Specifications, Materials, Manufacture, Assembly, and Installation

It will be understood that putter and golf ball deformity measuring apparatus implementations are not limited to the specific parts, devices and components disclosed in this document, as virtually any parts, devices and components consistent with the intended operation of a putter and golf ball deformity measuring apparatus implementation may be utilized. Accordingly, for example, although particular putter heads, putter faces, containment areas, oblong openings, spanning truss bars, beveled contact areas, and other parts, devices and components are disclosed, such may comprise any shape, size, style, type, model, version, class, measurement, concentration, material, weight, quantity, and/or the like consistent with the intended operation of a putter and golf ball deformity measuring apparatus implementation. Implementations are not limited to uses of any specific parts, devices and components; provided that the parts, devices and components selected are consistent with the intended operation of a putter and golf ball deformity measuring apparatus implementation.

Implementations of putter and golf ball deformity measuring apparatuses and implementing components may be constructed of a wide variety of materials. For example, the components may be formed of: polymers such as thermoplastics (such as Lexan®, ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as fiberglass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, tin, antimony, aluminum, any combination thereof, and/or other like materials; alloys, such as aluminum alloy, titanium alloy, magnesium alloy, copper alloy, any combination thereof, and/or other like materials; any other suitable material; and/or any combination of the foregoing thereof.

Some components defining putter and golf ball deformity measuring apparatus and putter and golf ball deformity measuring apparatus assembly implementations may be manufactured simultaneously and integrally joined with one another, while other components may be purchased pre-manufactured or manufactured separately and then assembled with the integral components. Various implementations may be manufactured using conventional procedures as added to and improved upon through the procedures described here. For the exemplary purposes of this disclosure, putter head 2 and putter face 6 may be manufactured simultaneously and integrally joined with one another. Also, putter head 2 and a golf putter shaft may be formed separately and then coupled together.

Accordingly, manufacture of these components separately or simultaneously may involve vacuum forming, injection molding, blow molding, casting, forging, cold rolling, milling, drilling, reaming, turning, grinding, stamping, pressing, cutting, bending, welding, soldering, hardening, riveting, punching, plating, and/or the like. Components manufactured separately may then be coupled or removably coupled with the other integral components in any manner, such as with adhesive, a weld joint, a solder joint, a fastener, washers, retainers, wrapping, wiring, any combination thereof, and/or the like for example, depending on, among other considerations, the particular material forming the components. For the exemplary purposes of this disclosure, one or more portions of putter head 2 may be milled.

Operation/Use

Putter and golf ball deformity measuring apparatus implementations may comprise golf putters capable of performing multiple functions, some or all of which have heretofore required a golfer to bend down, such as: to pick up a golf ball; to measure a golf ball to determine whether it is out of shape; to mark the position of a golf ball with a ball marker; to pick up a ball marker; to repair a ball mark or divot on a putting green; to store a divot tool when not in use; to align the putter to a golf hole and/or a golf ball; and to provide an auditory indication in the event of a well-struck putt. Nevertheless, implementations are not limited to uses relating to the foregoing. Rather, any description relating to the foregoing is for the exemplary purposes of this disclosure, and implementations may also be used with similar results for a variety of other applications.

In describing the use of putter and golf ball deformity measuring apparatus implementations further, for the exemplary purposes of this disclosure, and referring to FIGS. 1-7*h* and FIGS. 12*a*-15*i*, the operation of a putter and golf ball deformity measuring apparatus will now be described. A user wishing to pick up a golf ball that is on the ground (and simultaneously measure the ball for deformity) without bending over, may align oblong through hole 24 over a golf ball. With oblong through hole 24 positioned over a golf ball, a user may push putter head 2 in a downward direction so that the golf ball passes through oblong through hole 24 to containment area 22, where at least a portion of the golf ball is surrounded by containment area 22 (without the golf ball being gripped by putter head 2). It will be understood that when a golf ball passes through oblong through hole 24 into containment area, the golf ball may be caused to move or "walk" upwards between the spanning truss bar 24 and the beveled contact area 26. As a golf ball walks up upward between spanning truss bar 28 and beveled contact area 26, beveled contact area 26 may act as a ramp, such that an amount of spin is imparted to the golf ball (which may provide a visual indication of a ball that may be fit for play). It will be understood that, when a golf ball passes through oblong through hole 24 into containment area 22, and with bottom surface 21 of putter head 2 in contact with the ground, the golf ball may also be in contact with the ground, with at least portion of the golf ball surrounded by containment area 22. Nevertheless, when a golf ball passes through oblong through hole 24 into containment area 22, and when bottom surface 21 of putter head 2 in lifted off the ground (to a height of about half the diameter of the golf ball), it will be understood that the golf ball may only be in contact with spanning truss bar 28 and beveled contact area 26 of putter head 2. With a golf ball suspended between spanning truss bar 28 and beveled contact area 26, in particular implementations, a user may perform a further deformity measuring check on the golf ball by spinning the golf ball on various axes. It will be understood that, in other particular implementations, a golf ball having a deformity 41 and/or that is significantly out of shape (such as, by way of non-limiting example, oblong or egg-shaped) may bind or become wedged between spanning truss bar 28 and beveled contact area 26 as the ball is spun and/or may fall through oblong through hole 24 (particularly where, by way of non-limiting example, the deformity comprises a flattened section), thereby providing an indication to the user that the ball is out of shape and therefore unfit for play.

Still referring to FIGS. 1-7*h* and FIGS. 12*a*-15*i*, a user desiring to pick up a golf ball out of a golf hole (and simultaneously measure the golf ball for deformity) without bending down may insert putter head 2 into the golf hole so that at least a portion of rear portion 10 is below the top of the golf ball and at least a portion of front portion 4 is above the top of the golf ball. Referring specifically in FIG. 7*a*, with golf ball 36 in the center of golf hole 42 (as shown in FIG. 7*b*), when putter head 2 is inserted in golf hole 42, it will be seen that the oblong through hole 24 is off-center with respect to golf ball 36. As will be described more fully below, the off-center placement of the oblong through hole 24 may, among other things, allow the surface area of putter face 6 to be maximized without using an awkwardly or irregularly shaped putter face 6 and/or bottom surfaces 21. With putter head 2 oriented in golf hole 42, a user may thereafter rock putter head 2 (while pushing down putter head 2) so that at least a portion of rear portion 10 begins below the top of the golf ball and finishes above the top of the golf ball (and at least a portion of front portion 4 begins above the top of the golf ball and finishes below the top of the golf ball). It will be understood that rocking and pushing downward putter head 2 in the foregoing manner may provide sufficient energy to cause the golf ball to pass through oblong through hole 24 to containment area 22, where at least a portion of the golf ball is surrounded by, and by loosely maintained for collection by a user, by containment area 22. It will be further understood that putter head 2 is sized and shaped to allow a user to pick up a golf ball from within a golf hole.

Still referring to FIGS. 1-7*h* and FIGS. 12*a*-15*i*, whether a golf ball is being picked up (or measured) from off the ground, or from within a golf hole, spanning truss bar 28 and beveled contact area 26 play a critical role in both measuring and picking up a golf ball by a putter and golf ball deformity measuring apparatus. Significantly, a golf ball that has been picked up (or measured) by passing through oblong through hole 24 comprising a putter and golf ball deformity measuring apparatus may only be in contact with flat surface 29 of spanning truss bar 28 and beveled contact area 26, and no other portion of oblong through hole 24. It will be understood that a golf ball that is out-of-shape may pass through oblong through hole 24 with considerable difficulty, or not at all, thereby providing a ready indication to the player that their ball may be out of shape (and therefore unfit for play). Accordingly, the configuration of oblong through hole 24, in conjunction with spanning truss bar 24 and beveled contact area 26, may not only assist a golfer in picking up a golf ball without bending over, but may also assist a golfer in identifying and removing from play those golf balls that are determined to be out of shape and therefore unfit for play without bending over. The ability to assist a golfer in easily determining whether their golf ball is out of shape is important since, while a golf player may be able to readily visually determine whether their golf ball is cut or cracked (rendering it unfit for play), the ability to visually determine whether a ball is out of shape may be considerably more difficult, particularly where the ball is only mildly out of shape.

Referring to FIGS. 8*a* and 8*b*, the operation of a divot tool and divot tool docking port are described. Frequently, a golfer who has hit a successful approach shot to a putting green may find that their ball has left a "ball mark" or "divot" on the putting surface (especially when the greens are soft due to rain or some other reason). Since divots may interfere with the smooth on-line rolling of subsequent golfer's golf balls, conventional etiquette calls for golfers to repair any ball marks that they have made on the putting surface. Nevertheless, many golfers find it difficult, bothersome, or even impossible to bend down to repair their ball marks, frequently undesirably resulting in unrepaired ball marks on putting greens.

Referring specifically to FIG. 8*a*, the use of a divot tool 32 is explained. In the particular implementation shown, divot repair tool 32 may comprise divot repair tool body 39, one or more tines 33, ball marker 34, and slot 35 (obscured). Of course, divot repair tool 32 may comprise any configuration that allows divot repair tool 32 to be maintained in a position with one or more tines 33 projecting from putter head 2. With divot repair tool body 39 passed through divot tool docking port 11 (FIGS. 3 and 4) so that slot 35 is located within containment area 22, a user may insert ball marker 34 into slot 35 so that ball marker 34 is perpendicularly removably coupled with divot tool body 31 and held in place by magnet 13. It will be understood that the impingement of ball marker 34 on an inner portion of rear portion 10 (when ball marker 34 is inserted in slot 35) may prevent divot tool body 31 from being withdrawn from divot tool docking port 11. In addition, in particular implementations, divot repair tool 32 may comprise a step 37 (FIG. 8*b*) or other detenting feature which may prevent divot repair tool 32 from passing all the way into containment area 22 when ball marker 34 is inserted in slot 35 as shown.

Still referring to FIG. 8*a*, with divot repair tool 32 arranged as shown, a user may insert the one or more tines 33 into a ball mark created by the user (applying force with a user's foot, if necessary) and rock the putter head 2 away from the direction of the one or more tines 33. It will be understood that, in the particular implementation shown, front portion 4 may act as a fulcrum as the putter head 2 is rocked away from the direction of the one or more tines 33. It will be further understood that, as putter head 2 is rocked away from the direction of the one or more tines 33, the one or more tines 33 may gain elevation. Accordingly, in this particular implementation, a user may repair their ball marks without the requirement of bending down by inserting into a ball mark, and then causing the one or more tines 33 to lift. Once a ball mark is repaired by a user, the user may simply withdraw the one or more tines 33 from the repaired ball mark and store divot repair tool 32.

Referring to FIG. 8*b*, the storage of a divot repair tool 32 is described. With divot repair tool body 39 passed through divot tool docking port 11 (FIGS. 3 and 4) so that slot 35 is located outside containment area 22, a user may insert ball marker 34 into slot 35 so that ball marker 34 is perpendicularly removably coupled with divot tool body 31 and held in place by magnet 13. It will be understood that the impingement of ball marker 34 on an outer portion of rear portion 10 (when ball marker 34 is inserted in slot 35) may prevent divot tool body 31 from being withdrawn from divot tool docking port 11. In addition, in particular implementations, divot repair tool 32 may comprise a step 37 or other detenting feature which may prevent divot repair tool 32 from passing all the through divot tool docking port 11 when ball marker 34 is inserted in slot 35 as shown.

FIGS. 9*a*-9*k* illustrate a non-limiting example of a method of marking the position of a golf ball without bending down, using a putter and golf ball deformity measuring apparatus.

Figure 9A:
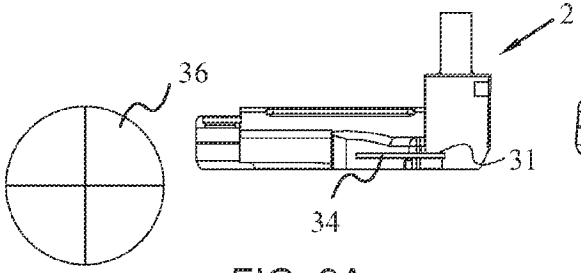
FIGS. 9*a*-9*k* illustrate a side view of a method of marking the position of a golf ball.
Figure 9B:
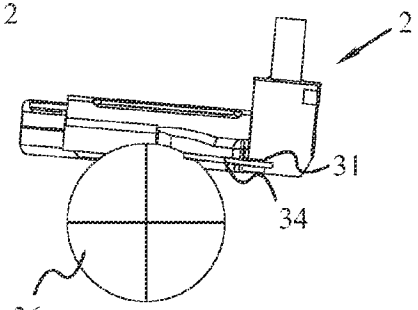
Figure 9C:
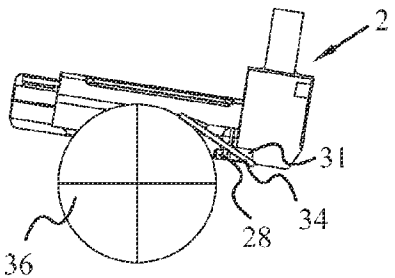
Figure 9D:
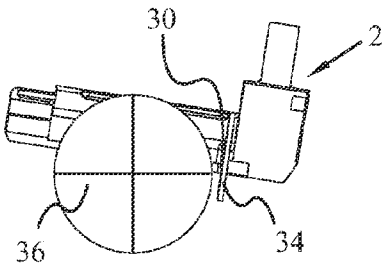
Figure 9E:
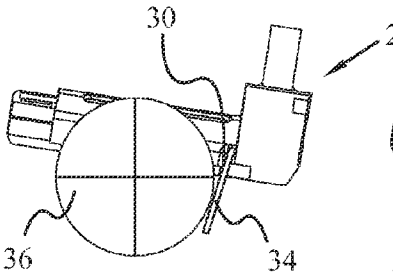
Figure 9F:
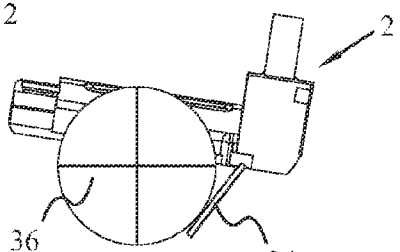
Figure 9G:
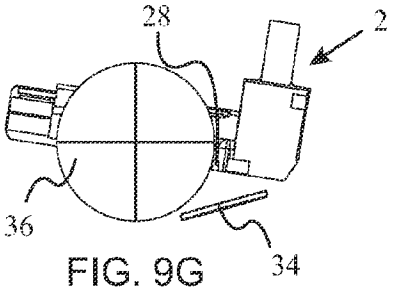
Figure 9H:
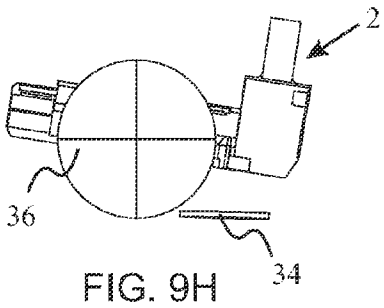
Figure 9I:
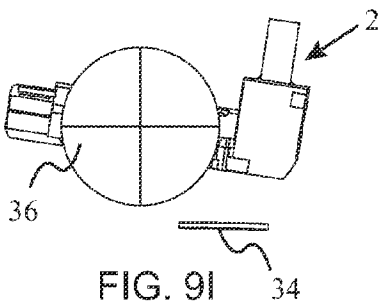
Figure 9J:
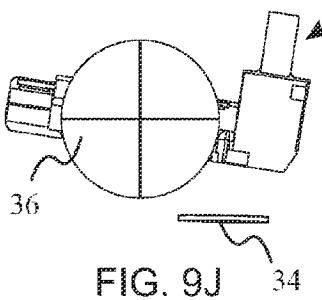
Figure 9K:
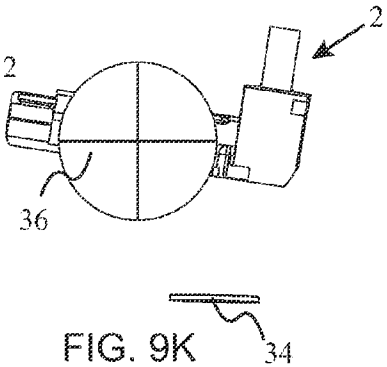

During golf play, once a player has successfully played their ball onto a putting green, the player is allowed under U.S.G.A. rules to mark their ball and then lift the ball. Putter head 2 comprises ball marker 34, marker seat 31, marker through slot 30, oblong through hole 24, and spanning truss bar 28. As shown in FIG. 9*a*, ball marker 34 may be seated in marker seat 31 so that one side of ball marker is removably coupled with marker seat 31 and one side of ball marker 34 remains free. After seating ball marker 34 in marker seat 31, a user may thereafter align oblong through hole 24 over a golf ball 36. As shown in the non-limiting example provided in FIG. 9*b*, as a user pushes putter head 2 downward (in the direction of the golf ball 36), the free side of ball marker 34 contacts golf ball 36. As a user continues to push down on putter head 2, ball marker begins to tilt, the spanning truss bar 28 acting as a fulcrum (FIG. 9*c*).

Still referring to FIGS. 9*a*-9*k*, when ball marker 34 reaches a tipping point during the downward travel of putter head 2, (FIG. 9*d*), ball marker 34 may slide through marker through slot 30, which is defined by spanning truss bar 28 and an edge of oblong through hole 24. FIGS. 9*e*-9*h* illustrate a non-limiting example of the path of travel that ball marker 34 may undergo once ball marker 34 has reached its tipping point, Of course, a user marking the position of their golf ball on a putting surface using a putter and golf ball deformity measuring apparatus may, in particular implementations, simultaneously pick up their golf ball without bending over, as depicted in the non-limiting examples provided in FIGS. 9*i*-9*k*. In other particular implementations, a user may use magnet 13, which may be included in rear portion 10, to pick up ball marker 34 without bending over.

Figures 10A, 10B, 10C, 10D, 10E, 10F:
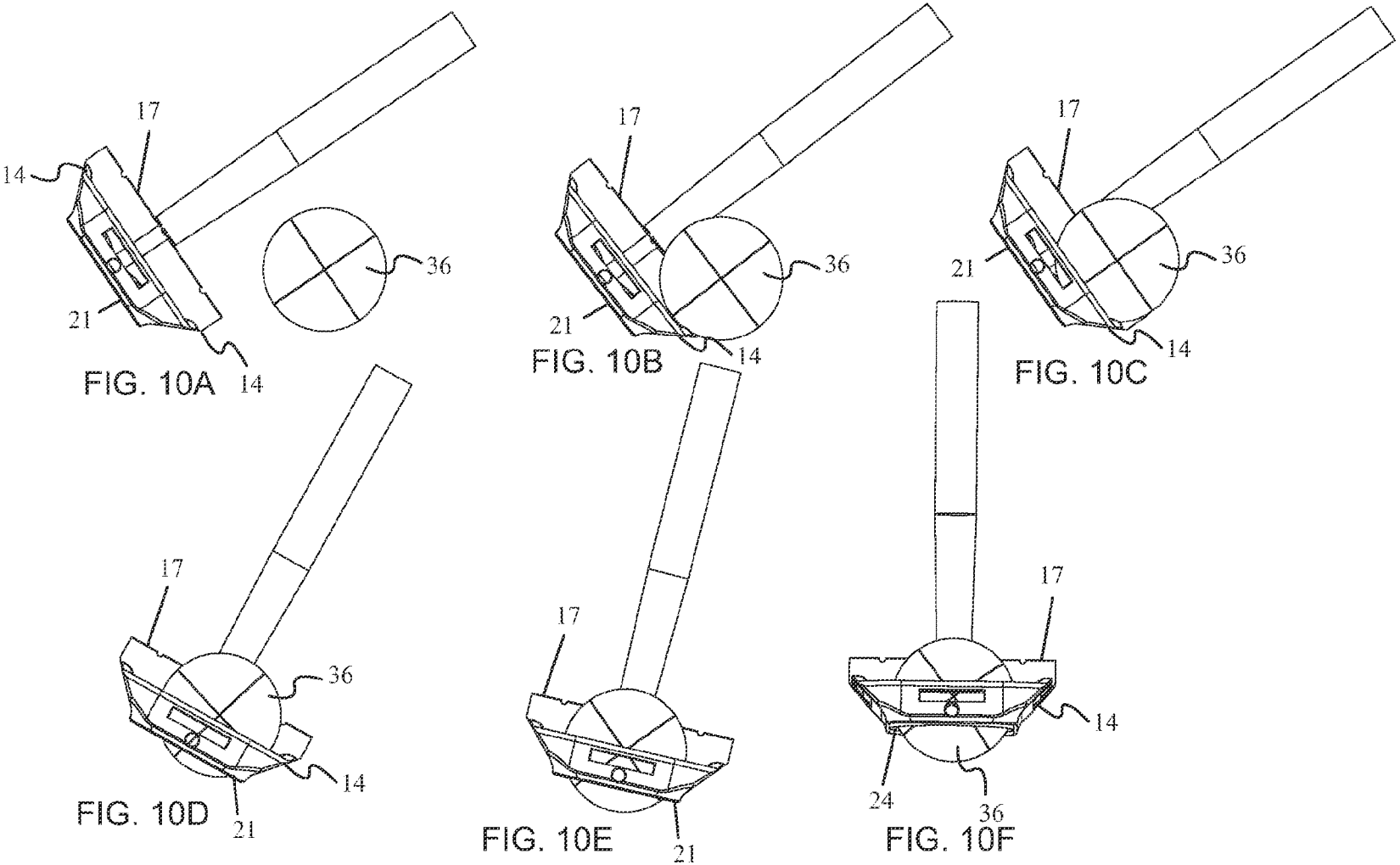
FIGS. 10*a*-10*f* show a rear view of an alternative method of picking up a golf ball.

FIGS. 10*a*-10*f* illustrate a non-limiting example of a method of scooping a golf ball with a putter and golf ball deformity measuring apparatus without the requirement of a user bending down. Specifically, a user desiring to scoop golf ball 36 off of the ground may tilt putter head 2 so that upper surface 17 is oriented obliquely with respect to a horizontal line which, by way of non-limiting example, could be a putting surface or other surface (FIG. 10*a*). With upper surface 17 oriented obliquely with respect to a horizontal line, a user may pull putter head 2 in the direction of golf ball 36 (FIGS. 10*b* and 10*c*). As can be seen from a comparison of FIG. 10*b* to FIG. 10*c*, as a user pulls putter head 2 towards golf ball 36, the golf ball may move towards containment area 22 by "climbing" opposing visual alignment slots 14. As can be seen in the non-limiting example provided in FIG. 10*d*, as golf ball 36 moves toward containment area 22, a user may rotate putter head 2 so that upper surface 17 moves toward a parallel position with respect to a horizontal line, so that golf ball 36 becomes fully seated within containment area 22. It will be understood from the non-limiting example provided in FIG. 10*f*, that when a user lifts putter head 2 off the ground (after successfully scooping up golf ball 36), the golf ball 36 may be in contact only with spanning truss bar 28 and beveled contact area 26.

Figure 11A:
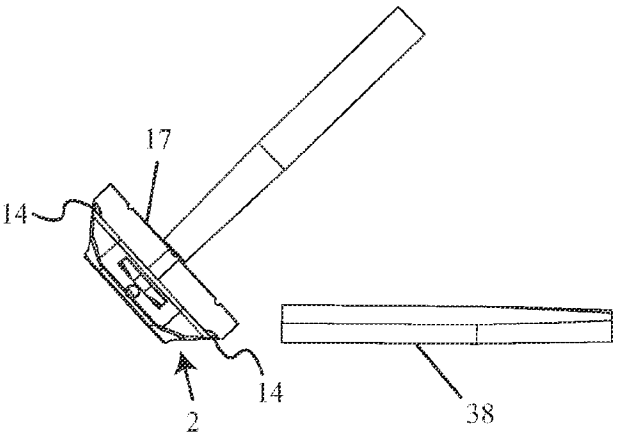
FIGS. 11*a*-11*e* illustrate a rear view of a method of picking up a golf club.
Figure 11B:
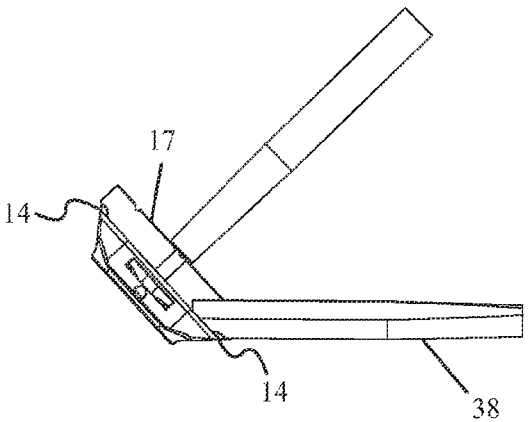
Figure 11C:
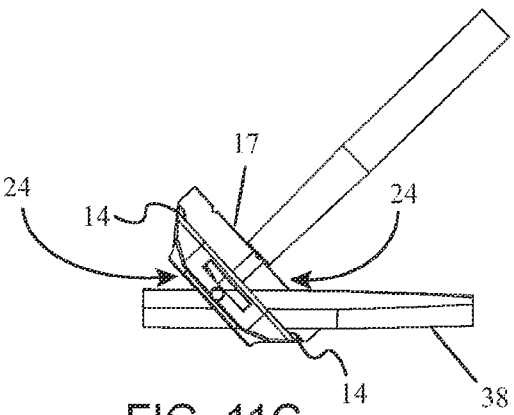
Figure 11D:
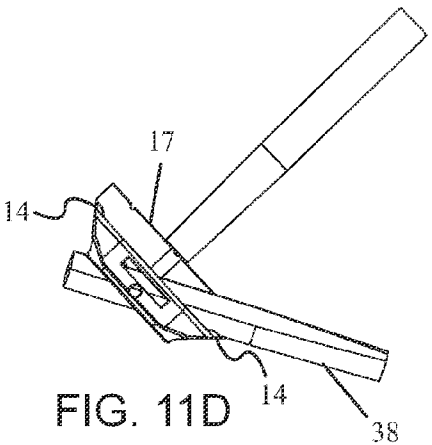
Figure 11E:
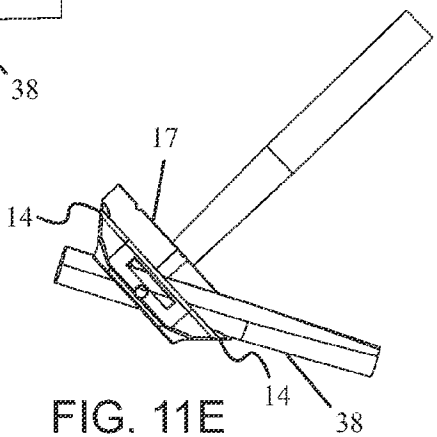
Figures 13A, 13B, 13C, 13D, 13E, 13F, 13G, 13H:
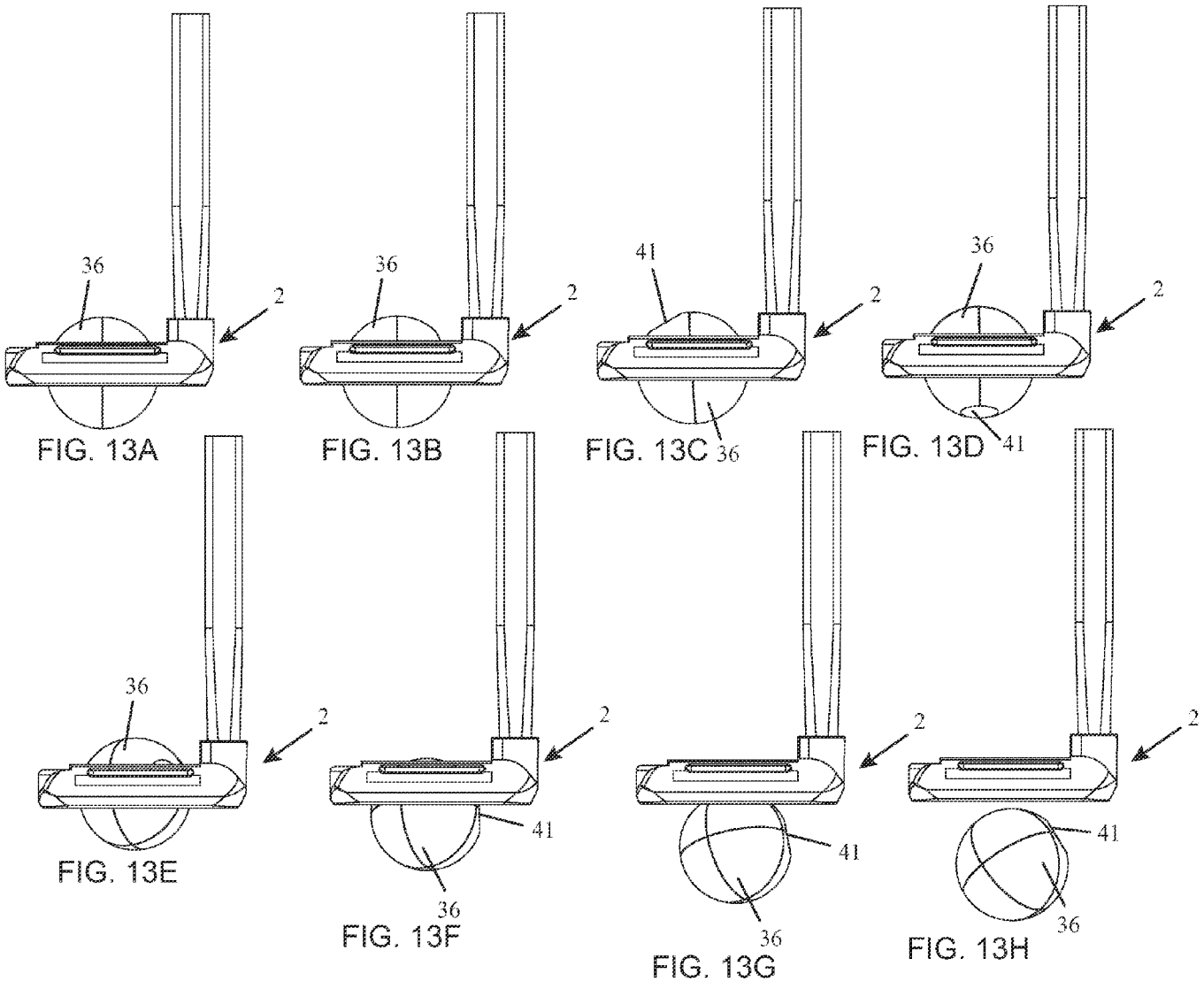
FIGS. 13*a*-13*h* illustrate a side view of an exemplary method of picking up and simultaneously checking a golf ball for deformity.
Figure 14A:
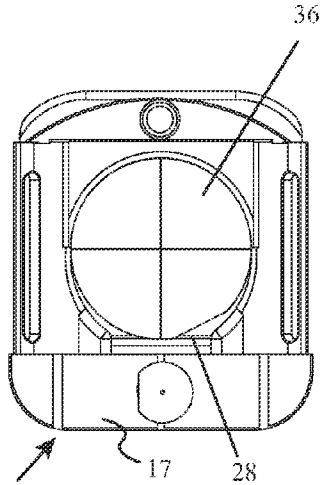
FIGS. 14*a*-14*h* illustrate a top view of an exemplary method of picking up and simultaneously checking a golf ball for deformity.
Figure 14B:
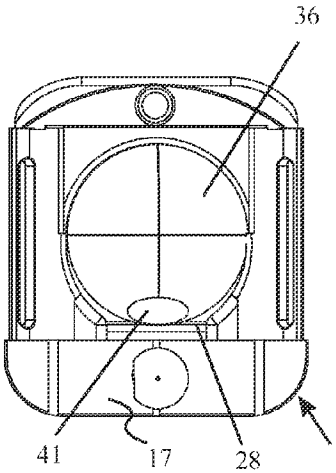
Figure 14C:
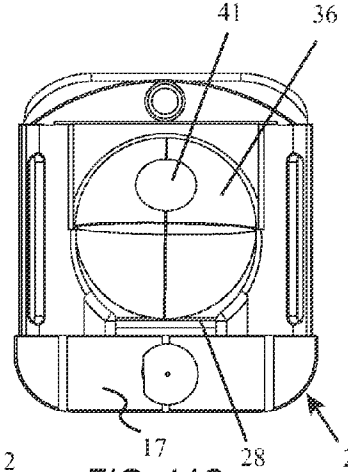
Figure 14D:
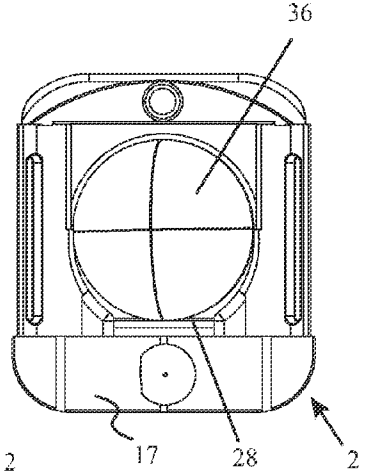
Figure 14E:
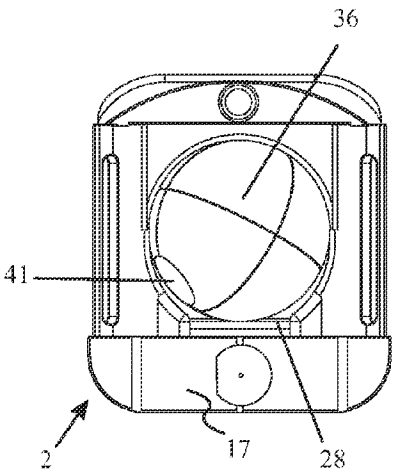
Figure 14F:
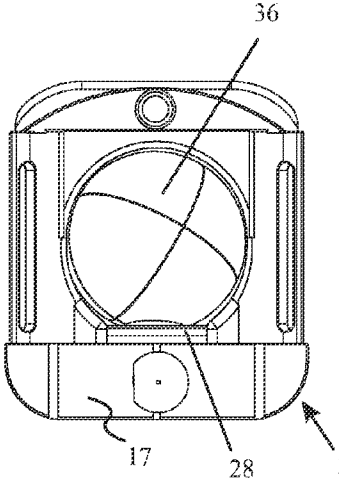
Figure 14G:
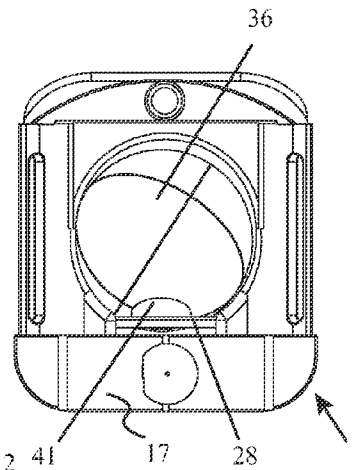
Figure 14H:
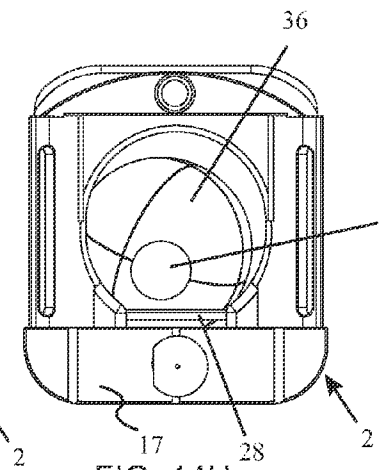
Figures 15A, 15B, 15C, 15D, 15E, 15F, 15G, 15H, 15I:
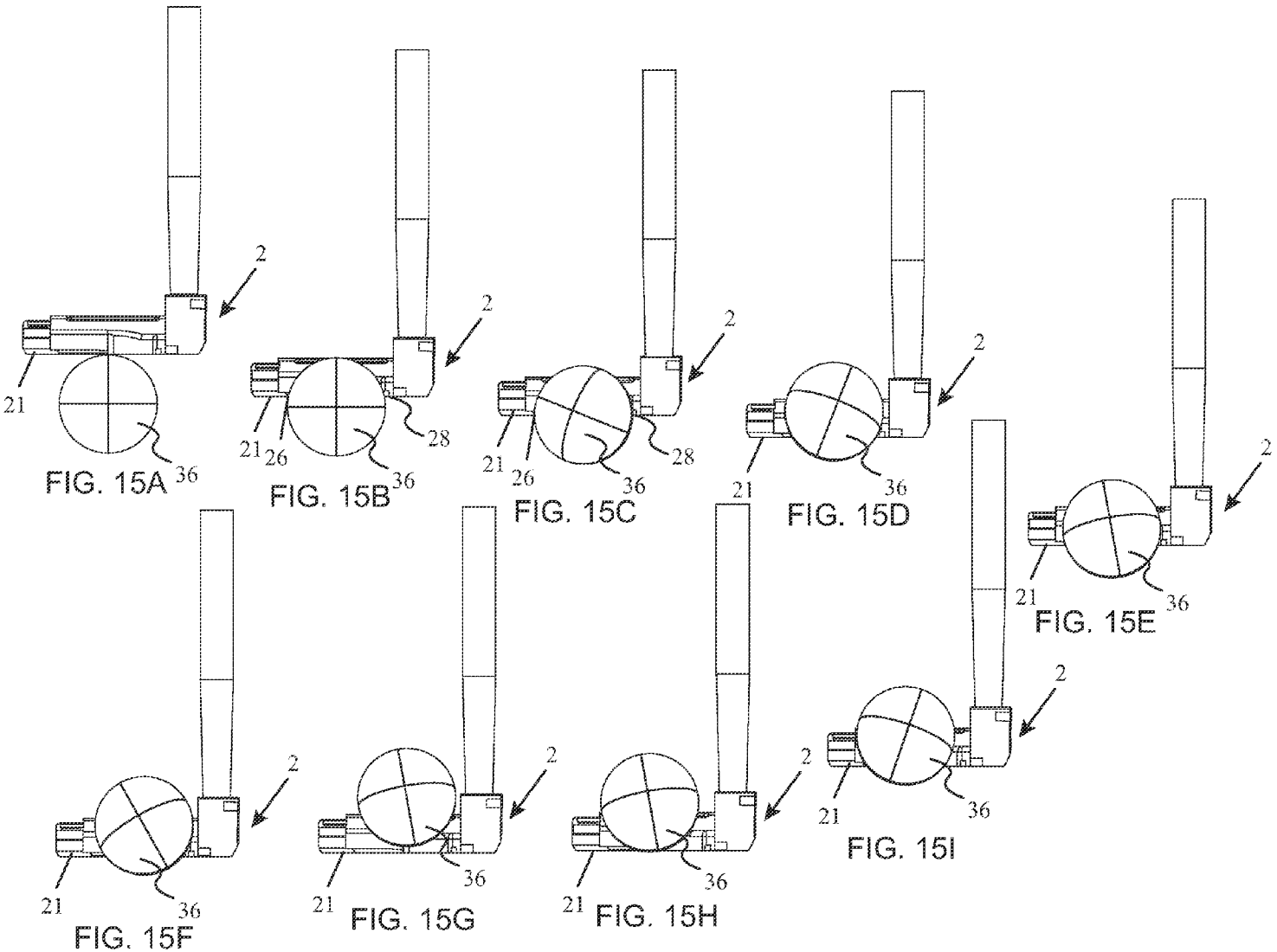
FIGS. 15*a*-15*i* illustrate a cut-away side view of an exemplary method of picking up and simultaneously checking a golf ball for deformity.

FIGS. 11*a*-11*e* illustrate a non-limiting example of a method of scooping a golf club handle or golf flag stick with a putter and golf ball deformity measuring apparatus without the requirement of a user bending down. Specifically, a user desiring to scoop golf club handle or golf flag stick 38 off of the ground may tilt putter head 2 so that upper surface 17 is oriented obliquely with respect to a horizontal line (FIG. 11*a*). With upper surface 17 oriented obliquely with respect to a horizontal line, a user may pull putter head 2 in the direction of golf club handle or golf flag stick 38 (FIGS. 11*b* and 11*c*). As can be seen from a comparison of FIG. 11*b* to FIG. 11*c*, as a user pulls putter head 2 towards golf club handle or golf flag stick 38, a portion of the golf club handle or golf flag stick 38 may pass through oblong through hole 24 via opposing visual alignment slots 14. As can be seen in the non-limiting examples provided in FIGS. 11*d* and 11*e*, once a portion of golf club handle or golf flag stick 38 has passed through oblong through hole 24, a user may lift putter head 2 upwards from a horizontal line, thereby lifting with it golf club handle or golf flag stick 38.

Contemplated implementations of a putter and golf ball deformity measuring apparatus are many and can apply in many situations. While the specific implementations of a putter and golf ball deformity measuring apparatus may initially be particularly useful in assisting golfers to avoid bending over to perform the typical functions required of a golfer during the course of play, they also have many additional implementations in various other golfing applications for which the desirability of the capabilities of the apparatus described will become readily apparent from the present disclosure. The specific parts, devices and components discussed in this application in no way restrict any possible implementation of the principles here disclosed. Additionally, while particular examples of components may be described in this disclosure, these examples do not serve to limit in any way the potential types of components or reconfigurability that may be implemented. Those skilled in the art will be able with the principles here disclosed to create many potential implementations.

The invention claimed is:

1. A putter and golf ball deformity measuring apparatus comprising:

a putter head comprising:

a front portion;

a rear portion;

a bottom portion defining an oblong through hole, the oblong through hole comprising a spanning truss bar and a beveled contact area opposite the spanning truss bar; and a containment area above the oblong through hole sized and shaped to surround at least a portion of a golf ball without gripping the golf ball, the containment area defined between the front portion and the rear portion.

2. The putter and golf ball deformity measuring apparatus of claim 1, wherein the containment area is crescent shaped in cross section.

3. The putter and golf ball deformity measuring apparatus of claim 1, wherein the containment area further comprises one or more opposing visual alignment slots.

4. The putter and golf ball deformity measuring apparatus of claim 1, wherein the spanning truss bar comprises an indentation facing the beveled contact area.

5. The putter and golf ball deformity measuring apparatus of claim 4, further comprising a marker seat defined in an edge of the oblong through hole, and a marker through slot defined between the truss bar and the marker seat.

6. The putter and golf ball deformity measuring apparatus of claim 1, wherein the front portion comprises a putter face.

7. The putter and golf ball deformity measuring apparatus of claim 6, wherein the putter face comprises a thermoplastic insert.

8. The putter and golf ball deformity measuring apparatus of claim 7, wherein the putter face comprises a tactile orifice behind the thermoplastic insert.

9. The putter and golf ball deformity measuring apparatus of claim 6, further comprising a shaft extending from the front portion of the putter head, wherein the putter face comprises a negative loft angle and at least a portion of the shaft is ahead of at least a portion of the putter face when the putter head is horizontal.

10. The putter and golf ball deformity measuring apparatus of claim 1, wherein the rear portion comprises a leveling aid.

11. The putter and golf ball deformity measuring apparatus of claim 1, wherein the putter head comprises a rear section, the rear section comprising a magnet.

12. The putter and golf ball deformity measuring apparatus of claim 1, wherein the putter head comprises a rear section, the rear section comprising a divot tool docking port.

13. A putter and golf ball deformity measuring apparatus comprising:

a putter head comprising:

a front portion comprising:

a putter face comprising a negative loft angle; and a shaft extending from the front portion of the putter head, wherein at least a portion of the shaft is ahead of at least a portion of the putter face when the putter head is horizontal;

a rear portion;

a bottom portion defining an oblong through hole, the oblong through hole comprising a spanning truss bar and a beveled contact area opposite the spanning truss bar; and a containment area above the oblong through hole sized and shaped to surround at least a portion of a golf ball without gripping the ball, the containment area defined between the front portion and the rear portion.

14. The putter and golf ball deformity measuring apparatus of claim 13, wherein the containment area is crescent shaped in cross section.

15. The putter and golf ball deformity measuring apparatus of claim 13, wherein the containment area further comprises one or more opposing visual alignment slots.

16. The putter and golf ball deformity measuring apparatus of claim 13, wherein the spanning truss bar comprises an indentation facing the beveled contact area.

17. The putter and golf ball deformity measuring apparatus of claim 13, further comprising a marker seat defined in an edge of the oblong through hole, and a marker through slot defined between the truss bar and the marker seat.

18. The putter and golf ball deformity measuring apparatus of claim 13, wherein the putter face comprises a thermoplastic insert.

19. The putter and golf ball deformity measuring apparatus of claim 18, wherein the putter face comprises a tactile orifice behind the thermoplastic insert.

20. The putter and golf ball deformity measuring apparatus of claim 13, wherein the rear portion comprises a leveling aid.

21. The putter and golf ball deformity measuring apparatus of claim 13, wherein the rear portion comprises a magnet.

22. The putter and golf ball deformity measuring apparatus of claim 13, wherein the rear portion comprises a divot tool docking port.

* * * * *